US010119704B2

(12) United States Patent
Colannino et al.

(10) Patent No.: US 10,119,704 B2
(45) Date of Patent: Nov. 6, 2018

(54) BURNER SYSTEM INCLUDING A NON-PLANAR PERFORATED FLAME HOLDER

(71) Applicant: CLEARSIGN COMBUSTION CORPORATION, Seattle, WA (US)

(72) Inventors: Joseph Colannino, Bellevue, WA (US); Douglas W. Karkow, Des Moines, WA (US); James K. Dansie, Renton, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 172 days.

(21) Appl. No.: 15/236,862

(22) Filed: Aug. 15, 2016

(65) Prior Publication Data

US 2017/0038063 A1 Feb. 9, 2017

Related U.S. Application Data

(63) Continuation-in-part of application No. PCT/US2015/016231, filed on Feb. 17, 2015, which is a continuation-in-part of application No. PCT/US2014/016632, filed on Feb. 14, 2014, application No. 15/236,862, which is a continuation-in-part of application No. 14/763,271, filed as application No. PCT/US2014/016628 on Feb. 14, 2014, now Pat. No. 9,857,076, application No. 15/236,862, which is a continuation-in-part of application No. 15/215,401, filed on Jul. 20, 2016, which is a continuation-in-part of application No. PCT/US2015/012843, filed on Jan. 26, 2015.

(60) Provisional application No. 61/765,022, filed on Feb. 14, 2013, provisional application No. 61/931,407, filed on Jan. 24, 2014.

(51) Int. Cl.
*F23D 14/14* (2006.01)

(52) U.S. Cl.
CPC ..... *F23D 14/14* (2013.01); *F23D 2203/102* (2013.01); *F23D 2203/104* (2013.01); *F23D 2203/1017* (2013.01); *F23D 2212/103* (2013.01)

(58) Field of Classification Search
CPC ..... F23D 14/14
USPC ..... 431/75, 329
See application file for complete search history.

(56) References Cited

U.S. PATENT DOCUMENTS 1,377,873 A * 5/1921 Chadick ..... F23D 11/46 431/33
2,828,813 A 4/1958 Holden
(Continued)

FOREIGN PATENT DOCUMENTS

JP 2006-275482 10/2006
WO WO 2013/181569 12/2013
(Continued)

OTHER PUBLICATIONS

PCT International Search Report and Written Opinion of PCT Application No. PCT/U52015/016231 dated May 26, 2015.
(Continued)

*Primary Examiner* — Avinash Savani
(74) *Attorney, Agent, or Firm* — Christopher A. Wiklof; Nicholas S. Bromer; Launchpad IP, Inc.

(57) ABSTRACT

A combustion system such as a furnace or boiler includes a non-planar perforated flame holder configured to hold a combustion reaction.

56 Claims, 9 Drawing Sheets

(56) References Cited

U.S. PATENT DOCUMENTS

| | | | | |
|---|---|---|---|---|
| 3,324,924 | A | 6/1967 | Hailstone et al. | |
| 3,439,996 | A | 4/1969 | Lherault et al. | |
| 3,847,536 | A * | 11/1974 | Lepage | F23D 14/14 431/329 |
| 4,021,188 | A | 5/1977 | Yamagishi et al. | |
| 4,081,958 | A | 4/1978 | Schelp | |
| 4,408,461 | A | 10/1983 | Bruhwiler et al. | |
| 4,413,976 | A * | 11/1983 | Scherer | F23Q 9/045 431/278 |
| 4,504,218 | A * | 3/1985 | Mihara | F23D 14/14 431/326 |
| 4,624,631 | A | 11/1986 | Kobayashi et al. | |
| 4,643,667 | A | 2/1987 | Fleming | |
| 4,673,349 | A | 6/1987 | Abe et al. | |
| 4,752,213 | A | 6/1988 | Grochowski et al. | |
| 4,906,180 | A | 3/1990 | Dvorak | |
| 5,275,552 | A | 1/1994 | Schwartz et al. | |
| 5,326,257 | A | 7/1994 | Taylor et al. | |
| 5,441,402 | A | 8/1995 | Reuther et al. | |
| 5,458,484 | A | 10/1995 | Ripka | |
| 5,511,516 | A | 4/1996 | Moore, Jr. et al. | |
| 5,641,282 | A | 6/1997 | Lee et al. | |
| 5,667,374 | A | 9/1997 | Nutcher et al. | |
| 5,718,573 | A | 2/1998 | Knight et al. | |
| 5,749,721 | A * | 5/1998 | Klinge | F23D 14/16 431/328 |
| 6,129,545 | A | 10/2000 | Kahlke et al. | |
| 6,140,658 | A | 10/2000 | Jarvinen | |
| 6,149,424 | A * | 11/2000 | Marrecau | F23D 14/16 126/92 AC |
| 6,428,312 | B1 | 8/2002 | Smelcer et al. | |
| 9,377,190 | B2 | 6/2016 | Karkow et al. | |
| 9,388,981 | B2 | 7/2016 | Karkow et al. | |
| 9,447,965 | B2 | 9/2016 | Karkow et al. | |
| 2002/0155403 | A1 | 10/2002 | Griffin et al. | |
| 2004/0058290 | A1 | 3/2004 | Mauzey et al. | |
| 2004/0152028 | A1* | 8/2004 | Singh | F23D 14/14 431/328 |
| 2004/0197719 | A1 | 10/2004 | Chung et al. | |
| 2006/0141413 | A1 | 6/2006 | Masten et al. | |
| 2008/0124666 | A1 | 5/2008 | Stocker et al. | |
| 2008/0268387 | A1 | 10/2008 | Saito et al. | |
| 2011/0076628 | A1 | 3/2011 | Miura et al. | |
| 2011/0076629 | A1 | 3/2011 | Mosiewicz | |
| 2012/0164590 | A1 | 6/2012 | Mach | |
| 2012/0231398 | A1 | 9/2012 | Carpentier et al. | |
| 2015/0276217 | A1 | 10/2015 | Karkow et al. | |
| 2015/0285491 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0362178 | A1 | 12/2015 | Karkow et al. | |
| 2015/0369477 | A1 | 12/2015 | Karkow et al. | |
| 2016/0003471 | A1 | 1/2016 | Karkow et al. | |
| 2016/0018103 | A1 | 1/2016 | Karkow et al. | |
| 2016/0025333 | A1 | 1/2016 | Karkow et al. | |
| 2016/0025374 | A1 | 1/2016 | Karkow et al. | |
| 2016/0025380 | A1 | 1/2016 | Karkow et al. | |
| 2016/0046524 | A1 | 2/2016 | Colannino et al. | |
| 2016/0091200 | A1 | 3/2016 | Colannino et al. | |
| 2016/0230984 | A1 | 8/2016 | Colannino et al. | |
| 2016/0238240 | A1 | 8/2016 | Colannino et al. | |
| 2016/0238242 | A1 | 8/2016 | Karkow et al. | |
| 2016/0238277 | A1 | 8/2016 | Colannino et al. | |
| 2016/0238318 | A1 | 8/2016 | Colannino et al. | |
| 2016/0245509 | A1 | 8/2016 | Karkow et al. | |
| 2016/0298840 | A1 | 10/2016 | Karkow et al. | |
| 2016/0305660 | A1 | 10/2016 | Colannino et al. | |

FOREIGN PATENT DOCUMENTS

| | | |
|---|---|---|
| WO | WO 2015/042615 | 3/2015 |
| WO | WO 2015/054323 | 4/2015 |
| WO | WO 2015/061760 | 4/2015 |
| WO | WO 2015/070188 | 5/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123701 | 8/2015 |
| WO | WO 2016/007564 | 1/2016 |
| WO | WO 2016/105489 | 6/2016 |
| WO | WO 2016/133934 | 8/2016 |
| WO | WO 2016/133936 | 8/2016 |
| WO | WO 2016/134061 | 8/2016 |
| WO | WO 2016/134068 | 8/2016 |
| WO | WO 2016/141362 | 9/2016 |

OTHER PUBLICATIONS

PCT International Search Report and Written Opinion of PCT Application No. PCT/U52014/016628 dated May 27, 2014.

PCT International Search Report and Written Opinion of PCT Application No. PCT/U52014/016632 dated May 26, 2014.

PCT International Search Report and Written Opinion of PCT Application No. PCT/US2015/012843 dated May 7, 2015.

Fric, Thomas F., "Effects of Fuel-Air Unmixedness on NOx Emissions," Sep.-Oct. 1993. Journal of Propulsion and Power, vol. 9, No. 5, pp. 708-713.

* cited by examiner

BURNER SYSTEM INCLUDING A NON-PLANAR PERFORATED FLAME HOLDER

CROSS REFERENCE TO RELATED APPLICATIONS

The present application is a U.S. Continuation-in-Part application which claims priority benefit under 35 U.S.C. § 120 (pre-AIA) of co-pending International Patent Application No. PCT/US2015/016231 entitled "BURNER SYSTEM INCLUDING A NON-PLANAR PERFORATED FLAME HOLDER," filed Feb. 17, 2015. Co-pending International Patent Application No. PCT/US2015/016231 claims priority benefit from International Patent Application No. PCT/US2014/016632, entitled "FUEL COMBUSTION WITH A PERFORATED REACTION HOLDER," filed Feb. 14, 2014. The present application is also a Continuation-in-Part of co-pending U.S. patent application Ser. No. 14/763,271, entitled "PERFORATED FLAME HOLDER AND BURNER INCLUDING A PERFORATED FLAME HOLDER," filed Jul. 24, 2015. Co-pending U.S. patent application Ser. No. 14/763,271 claims priority benefit to International Patent Application No. PCT/US2014/016628, entitled "PERFORATED FLAME HOLDER AND BURNER INCLUDING A PERFORATED FLAME HOLDER," filed Feb. 14, 2014. International Patent Application No. PCT/US2014/016628 claims the benefit of U.S. Provisional Patent Application No. 61/765,022, entitled "PERFORATED FLAME HOLDER AND BURNER INCLUDING A PERFORATED FLAME HOLDER," filed Feb. 14, 2013. The present application is also a Continuation-in-Part of co-pending U.S. patent application Ser. No. 15/215,401, entitled "LOW $NO_X$ FIRE TUBE BOILER," filed Jul. 20, 2016. Co-pending U.S. patent application Ser. No. 15/215,401 claims priority benefit to International Patent Application No. PCT/US2015/012843, entitled "LOW $NO_X$ FIRE TUBE BOILER," filed Jan. 26, 2015. International Patent Application No. PCT/US2015/012843 claims the benefit of U.S. Provisional Patent Application No. 61/931,407, entitled "LOW $NO_X$ FIRE TUBE BOILER," filed Jan. 24, 2014. Each of the international patent applications, U.S. patent applications, and U.S. provisional patent applications listed in this paragraph are, to the extent not inconsistent with the disclosure herein, incorporated by reference.

SUMMARY

According to an embodiment, a non-planar perforated flame holder includes an input face configured to receive a fuel-air mixture. The non-planar perforated flame holder includes an output face configured to emit products of a combustion reaction of the fuel-air mixture. The non-planar perforated flame holder includes a non-planar flame holder body having a plurality of perforations extending from the input face to the output face and collectively configured to promote the combustion reaction of the fuel-air mixture within the perforations.

According to an embodiment, a combustion system includes a fuel nozzle configured to emit a fuel stream. The combustion system includes a non-planar perforated flame holder positioned downstream from the fuel nozzle to receive a fuel-air mixture. The fuel-air mixture can be an air-entrained mixture of the fuel stream. The non-planar perforated flame holder includes an input face configured to receive the fuel-air mixture. The non-planar perforated flame holder includes an output face configured to emit products of a combustion reaction of the fuel-air mixture. The non-planar perforated flame holder includes a non-planar flame holder body having a plurality of perforations extending from the input face to the output face and collectively configured to promote the combustion reaction of the fuel-air mixture within the perforations.

According to an embodiment, a method of operating a combustion system includes outputting fuel from a nozzle to generate a fuel-air mixture. The method includes receiving the fuel-air mixture with a non-planar perforated flame holder. The non-planar perforated flame holder includes a plurality of perforations that extend from an input face to an output face of the non-planar perforated flame holder. The method includes sustaining a combustion reaction of the fuel-air mixture substantially within the plurality of perforations.

DETAILED DESCRIPTION

Figure 1:
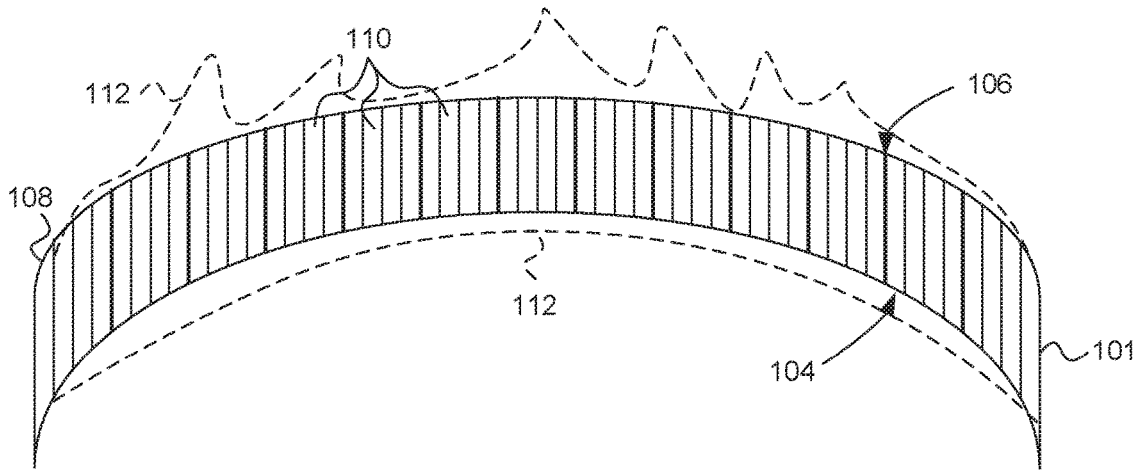
FIG. 1 is a side sectional view of a perforated flame holder that includes one or more non-planar faces, according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

According to one embodiment, a non-planar perforated flame holder can equalize fuel-air mixture flow rates across the input face of the perforated flame holder. In some embodiments, fuel and oxidant flow are characterized by a series of vortices (e.g., as a Von Karman vortex street). Accordingly, an instantaneous maximum flow velocity of a fuel-air mixture is unpredictable with respect to where it occurs, relative to an axis of a fuel nozzle. However, the inventors note that instantaneous flow rate may have the highest probability of being maximum along the nozzle axis (depending on nozzle geometry) at any instant in time, and the probability of encountering the maximum instantaneous flow rate declines off-axis. On a time-averaged basis, therefore, fuel and oxidant mixture velocity may be highest along a fuel stream axis. Accordingly, fuel flow rate may be generally equalized by placing a central portion of a perforated flame holder farther away from a fuel nozzle and a peripheral portion of the perforated flame holder closer to the fuel nozzle.

According to another embodiment, a non-planar perforated flame holder can provide superior mechanical robustness compared to a planar perforated flame holder. In a vertical-upward burner geometry, for example, a planar perforated flame holder can place its input face under a concentrated tensile load to maintain beam strength of the flame holder structure. At elevated temperatures and long maintenance cycles characteristic of many burner applications, tensile load on a ceramic, cementatious, or refractory fiber perforated flame holder can limit mechanical reliability due to tensile failure. Moreover, inclusion of metal alloy structures to support tensile loads can be undesirable due to temperature, cost, radiation pattern blockage, and/or other concerns. Accordingly, forming a perforated flame holder in an arch can provide reduced tensile loading and increase mechanical robustness. For example, forming the perforated flame holder in the shape of a catenary arch can substantially eliminate tensile loading on the perforated flame holder.

Alternatively, forming all or a portion of the non-planar perforated flame holder in a downward sag can spread out tensile loading across the section of a perforated flame holder and reduce tensile load concentration. For example, a catenary suspension can equalize tensile loading across the section.

According to another embodiment, a non-planar perforated flame holder can provide a selected thermal radiation pattern from the open faces of the perforated flame holder. The inventors have noted that most thermal radiation is often emitted from perforation walls near the input face and output face of the perforated flame holder. By selecting a non-planar perforated flame holder shape, the radiating surface view factor can be increased in a selected direction and decreased in another selected direction. This can be used, for example, to maintain radiative heating of one portion of a perforated flame holder from another portion of the perforated flame holder. Additionally or alternatively, view factor selection can be used to minimize or maximize thermal radiation onto heat transfer surfaces, support structures, fuel and oxidant sources, etc. within a furnace.

FIG. 1 is a side sectional view of a perforated flame holder 101 that includes one or more non-planar faces to generally equalize fuel flow rate, provide mechanical robustness, and define thermal radiation patterns, according to one embodiment. In other words, the perforated flame holder 101 may be non-planar shaped. The perforated flame holder 101 includes an input face 104 and an output face 106. The input face 104 is disposed towards the direction of a source of a fuel-air mixture, and is configured to receive the fuel-air mixture from the source. The output face 106 is disposed away from the source of the fuel-air mixture, and is configured to emit combustion products. The perforated flame holder 101 also includes a non-planar perforated flame holder body 108 and a plurality of perforations 110 that extend through the flame holder body 108 from the input face 104 to the output face 106. An example of a combustion product generated by the perforated flame holder 101, in response to receipt of the fuel-air mixture, is a stable primary flame 112.

Figure 2:
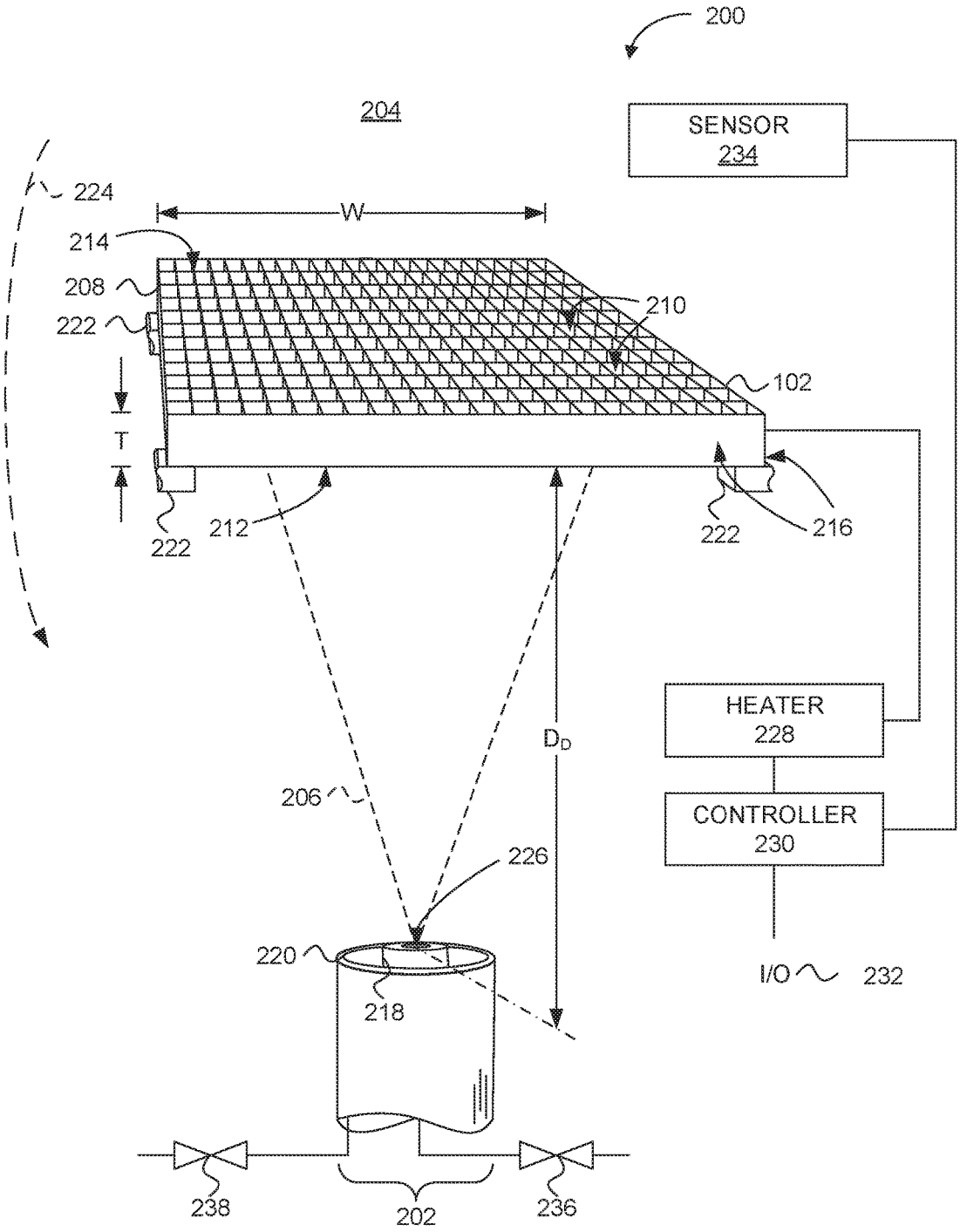
FIG. 2 is a simplified perspective view of a burner system including a perforated flame holder, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
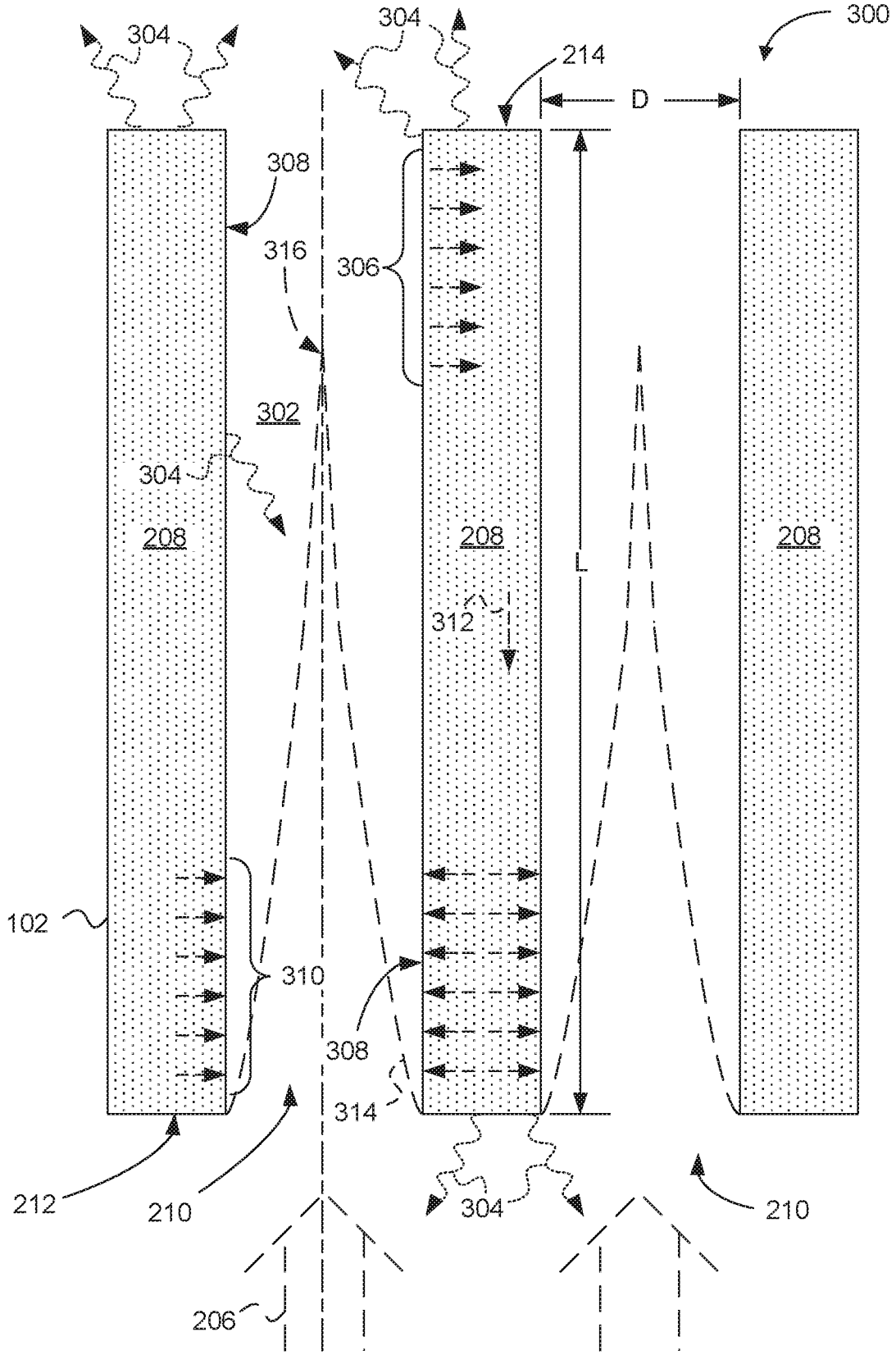
FIG. 3 is a side sectional diagram of a portion of the perforated flame holder of FIGS. 1 and 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 202. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 308 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
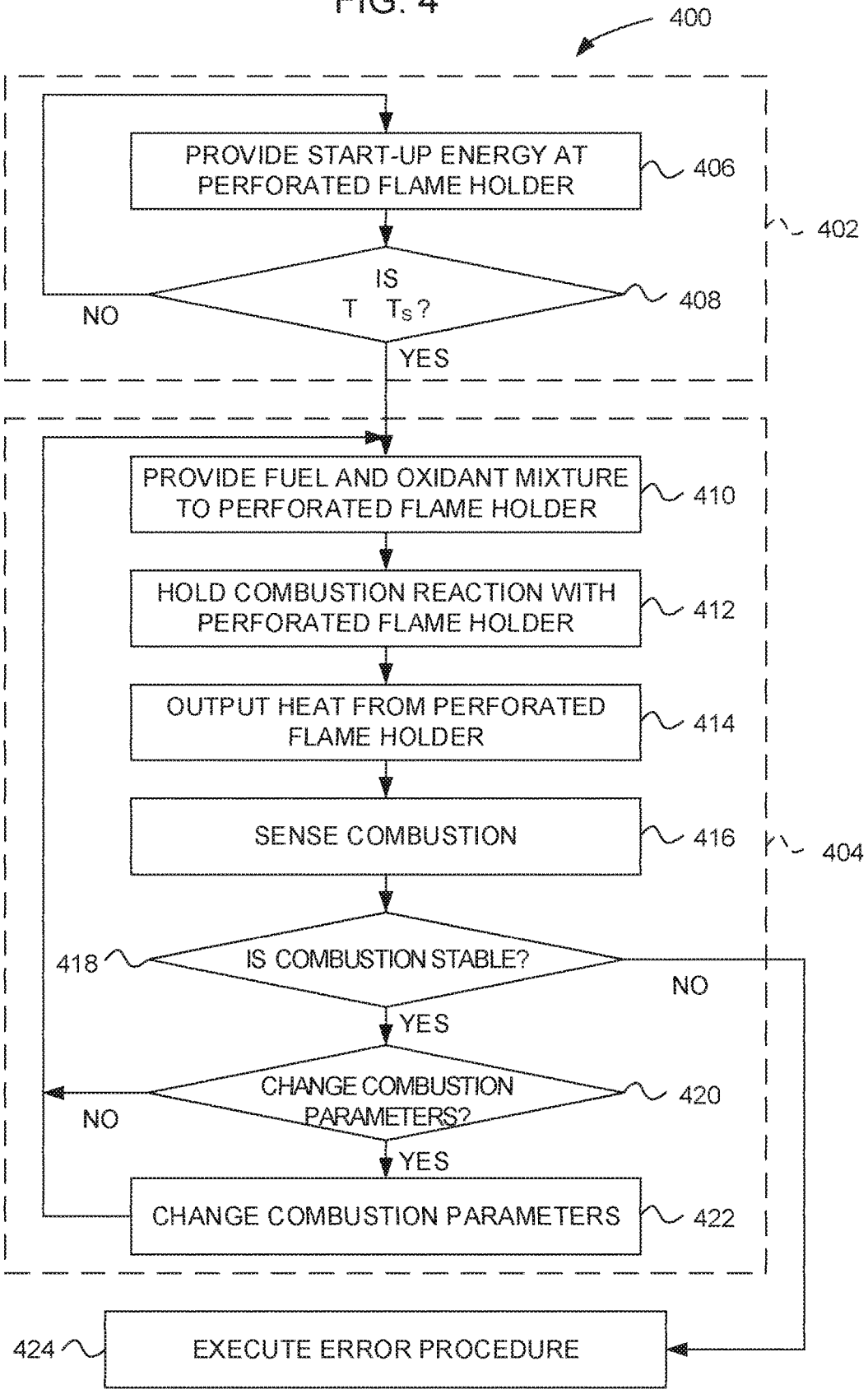
FIG. 4 is a flow chart showing a method for operating a burner system including the perforated flame holder of FIGS. 1, 2 and 3, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder.

Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, reexecuting the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 202. The controller 230 can be configured to control the fuel control valve 236 responsive to input from the combustion sensor 234. The controller 230 can be configured to control the fuel control valve 236 and/or oxidant blower or damper to control a preheat flame type of heater 228 to heat the perforated flame holder 102 to an operating temperature. The controller 230 can similarly control the fuel control valve 236 and/or the oxidant blower or damper to change the fuel and oxidant mixture 206 flow responsive to a heat demand change received as data via the data interface 232.

Figure 5:
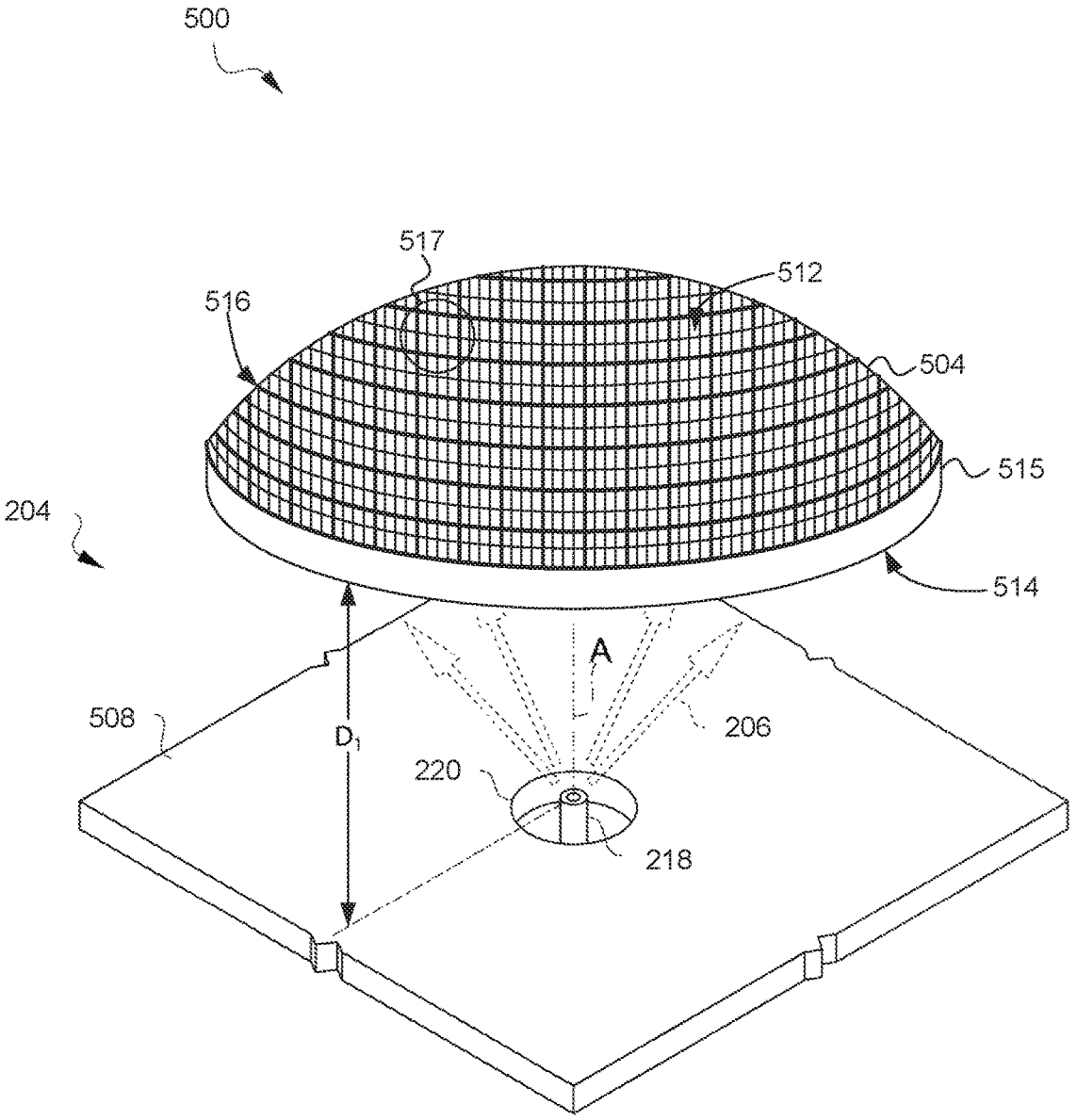
FIG. 5 is a simplified perspective view of a combustion system including a non-planar perforated flame holder, according to an embodiment.

FIG. 5 is a diagrammatic perspective view of a combustion system 500, according to an embodiment. The combustion system 500 includes a nozzle 218 and a perforated flame holder 504 positioned within a combustion volume 204. As illustrated, the perforated flame holder 504 of FIG. 5 is non-planar in shape.

In the embodiment shown, the perforated flame holder 504 includes a plurality of perforations 512, an input face 514, a perimeter wall 515, an output face 516, and a plurality of sections 517. The input and output faces 514, 516 of the perforated flame holder 504 are non-planar, and are rotationally symmetric to the plane that is perpendicular to the longitudinal axis of the nozzle 218. Other non-planar embodiments of the flame holder are possible, and some of the other possible embodiments of a non-planar flame holder are disclosed in FIGS. 6-9 and the corresponding description.

The input and output faces 514, 516 of the perforated flame holder 504 include one of a number of non-planar shapes. The input and output faces 514, 516 can have the same non-planar shapes, can have different non-planar shapes, or can have one non-planar shape and one planar shape, according to various embodiments. The input and output faces 514, 516 can have the shape of a catenary arch, which can use pure compression for supporting the plurality of sections 517 over the nozzle 218. The input and output faces 514, 516 can alternatively be parabolic, spherical, a stepped shape, or another non-planar shape, configured to displace the middle or center of the perforated flame holder 504 to the same or to a greater distance from the nozzle 218 than a planar perforated flame holder. The input face 514 is concavely rotationally symmetric, and the output face 516 is convexly rotationally symmetric, according to one embodiment.

The plurality of sections 517 can be configured in various shapes and sizes to form the perforated flame holder 504. Each of the plurality of sections 517 is a tile, according to one embodiment. Each of the plurality of sections 517 can be cubical, rectangular, triangular, hexagonal, otherwise polygonal, or asymmetric so that the sections, e.g., tiles, naturally fit closely together over a spherical or arcuate surface. The plurality of sections 517 are cemented, adhered, or otherwise coupled together. The plurality of sections 517 can be formed directly in the curved shape, for example, by using a mold. The plurality of sections 517 can be sized to pass through a man-hole or other access into the combustion system 500 to facilitate replacement of damaged sections and to facilitate erection of the non-planar perforated flame holder 504.

The arch of the perforated flame holder 504 is determined by a departure angle of the output or input face from a plane that is perpendicular to the longitudinal axis of the nozzle 218. The departure angle defines an angular displacement of an end of the non-planar flame holder from a center of the non-planar flame holder. The departure angle can be measured from a plane that is perpendicular to the longitudinal axis of the center of the non-planar flame holder. The departure angle can be approximately 45 degrees, so that one end of the perforated flame holder 504 to another sweeps through a total angle of approximately 90 degrees. In alternative embodiments, the departure angle can be greater than or equal to 15 degree, greater than or equal to 30 degrees, or is some angle between 5-45 degrees.

The arch of the input face 514 increases inward projections of thermal radiation 304, to improve the operation of the perforated flame holder 504, according to one embodiment. Most of the thermal radiation 304 comes from inside each of the plurality of perforations 512, e.g., from the last centimeter of the length of the perforation. Because the non-planar shape (e.g., arch, parabola, spherical) of the input face 514 increases the view factor between the plurality of perforations 512 on opposite sides of the perforated flame holder 504, more thermal radiation can be recycled/reused by the perforated flame holder 504. For example, one or more first perforations 512 of the input face 514 receive and transmit more thermal radiation 304 with one or more second perforations of the input face 514. Inter-perforation radiation may help the non-planar perforated flame holder maintain a temperature that sustains the combustion reaction.

The arch of the output face 516 increases the outward projections of thermal radiation 304, to improve the operation of the combustion system 500. For example, because arch of the output face 516 increases the view factor between the perforations of the output face 516 and the periphery of the perforated flame holder 504, the thermal radiation 304 can be directed towards a plurality of radiant section working fluid tubes 550 disposed proximate or adjacent to the perforated flame holder 504. The outward projections of the thermal radiation 304 can heat the plurality of radiant section working fluid tubes, for use by one or more other systems. In another embodiment the combustion system 500 can include "water walls" that include tubes for circulating a working fluid in the walls, which is a typical configuration for water-tube boilers used in large applications such as power generation.

As discussed above, the non-planar shape of the input and output faces 514, 516 can provide mechanical robustness for the perforated flame holder 504 and can equalize fuel-air mixture flow rates across the input face of the perforated flame holder 504. The non-planar shape of the input and output faces 514, 516 reduces tensile loading on the input face by distributing the compressive loading of the output face through the perforated flame holder body, as discussed above. The non-planar shape of the flame holder may generally equalize the fuel flow rate to the input face by placing a central portion of a perforated flame holder 504 farther away from the fuel nozzle 218 and by placing a peripheral portion of the perforated flame holder 504 closer to the fuel nozzle 218.

The perforated flame holder 504 spans the combustion system 500 by a width W. The width W of the perforated flame holder 504, in one embodiment, is approximately 2 feet. In another embodiment, the width W of the perforated flame holder 504 is greater than or equal to 9 feet. Other lengths or diameters are also achievable, in accordance with various combustion system configurations.

Figure 6:
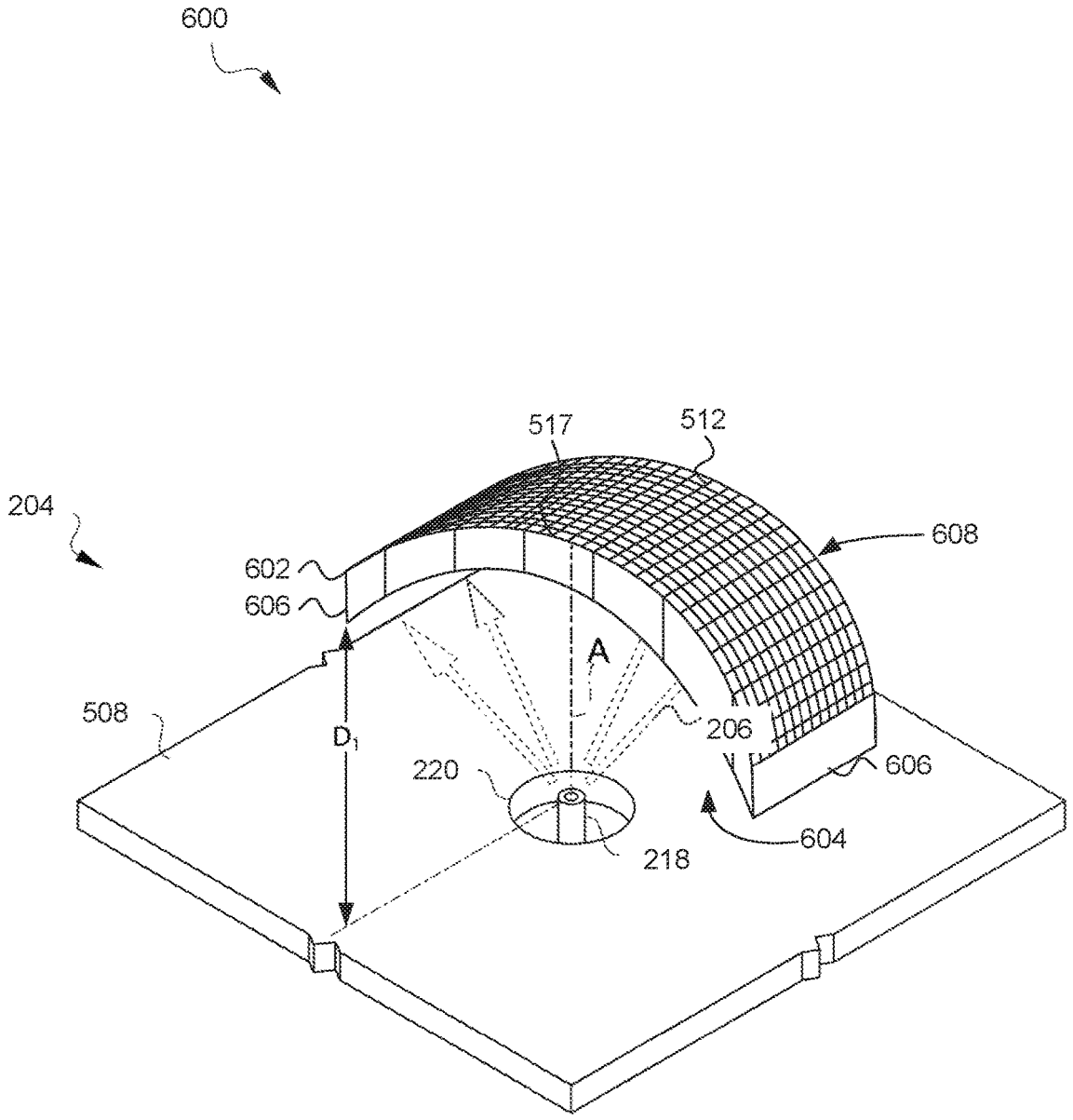
FIG. 6 is a simplified perspective view of a combustion system including a non-planar perforated flame holder, according to an embodiment.

FIG. 6 is a diagrammatic perspective view of a combustion system 600, according to an embodiment. The combustion system 600 includes a perforated flame holder 602 that is non-planar shaped, and which is positioned within the combustion volume 204 to sustain a combustion reaction.

The perforated flame holder 602 includes an input face 604, an outer wall 606, and an output face 608. The perforated flame holder 602 includes a plurality of perforations 512 that extend from the input face (or surface) 604 to the output face 608 of the flame holder 602. The plurality of perforations 512 are rectangular, but can also be cylindrical, elliptical, or a polygonal prism, according to various embodiments.

The perforated flame holder 602 is a two-dimensional arch that is lower at the walls 606 than at the center. The input face 604 is plane symmetric and concavely arcuate, and the output face 608 is plane symmetric and convexly arcuate, according to one embodiment.

The sections 517 of the perforated flame holder 602 are substantially directly coupled to adjacent sections 517. However, in one embodiment, contact between adjacent sections 517 is limited to a single edge (and not a surface), and adjacent sections 517 are substantially coupled through an adhesive such as cement or ceramic material.

The combustion system 600 illustrates a single nozzle 218 and a single perforated flame holder 602. However, in other embodiments, multiple perforated flame holders with the arcuate shape of flame holder 602 can be joined side-by-side or can be spaced apart side-by-side over the nozzle 218 to sustain a combustion reaction in the combustion system 600.

Figure 7A:
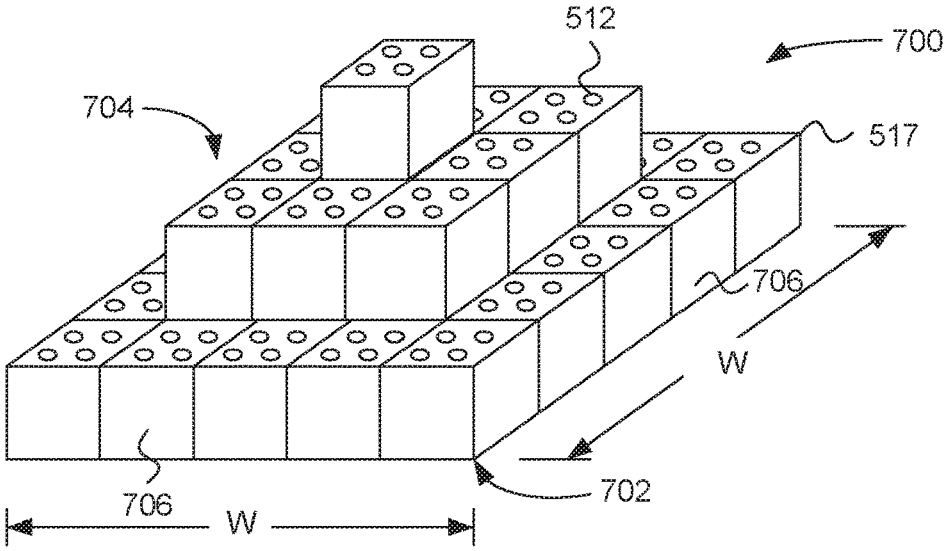
FIG. 7A is a simplified perspective view of a non-planar perforated flame holder, according to an embodiment.
Figure 7B:
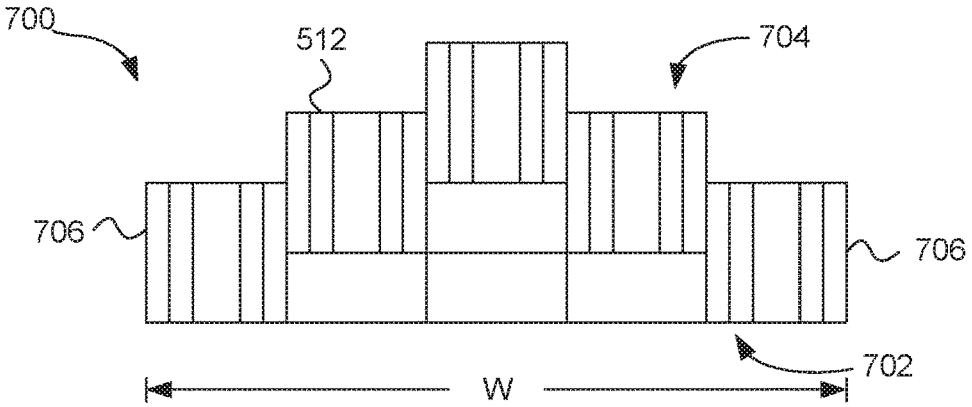
FIG. 7B is a simplified side sectional view of the non-planar perforated flame holder of FIG. 7A, according to an embodiment.

FIG. 7A is a diagrammatic perspective view of a perforated flame holder 700 that is non-planar shaped, according to another embodiment. The perforated flame holder 700 employs an axially symmetric stepped arch. The stepped arch includes a plurality of sections 517, e.g., ceramic blocks, bricks, or tiles. The perforated flame holder 700 includes an input face 702, an output face 704, and a perimeter wall 706, according to one embodiment. The input face 702 is concavely arched, and the output face 704 is convexly arched, according to one embodiment. The perforated flame holder 700 includes the plurality of perforations 512 that extend from the input face 702 to the output face 704 of the flame holder. The sections 517 of the perforated flame holder 700 are adhered or otherwise coupled together with overlapping portions of the sections 517. FIG. 7B is a diagrammatic side sectional view of the perforated flame holder 700, according to an embodiment.

Figure 7C:
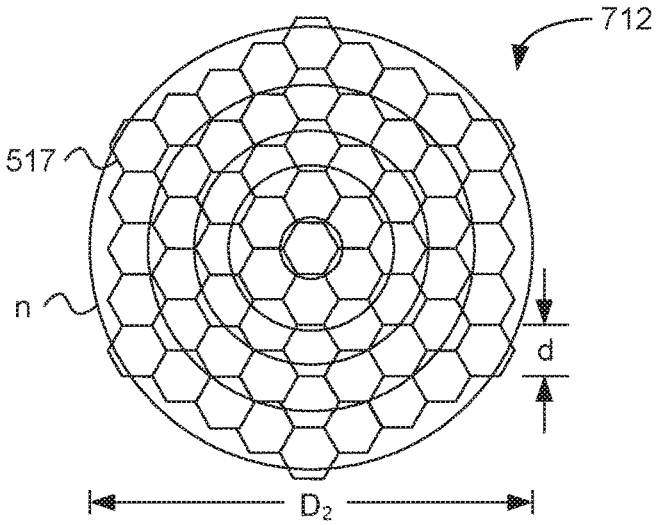
FIG. 7C is a simplified plan view of an alternate implementation of the non-planar perforated flame holder of FIG. 7A, according to an embodiment.

FIG. 7C is a diagrammatic plan view of a perforated flame holder 712 that is non-planar shaped, which uses hexagonal prism sections 517 rather than cubes, to provide a stepped arch, according to an embodiment.

The perforated flame holder 712 includes a number of steps n, which include sections (or members) 517 having a distanced between flat sides of each section, e.g., tile. The total number of tiles N can be represented by different equations. For example, a first equation:

$$N=3n(n-1)+1 \quad \text{(Equation 1)}$$

describes the total number of tiles N in terms of the number of steps used in the perforated flame holder 712. A second equation:

$$N=(3/4)*[(D_2/d)^2-1], \quad \text{(Equation 2)}$$

where $D_2$ is the diameter of the flame holder, (Equation 2) describes the total number of tiles N in terms of the distance d between flat sides of each section 517 and in terms of the diameter $D_2$ of the perforated flame holder 712.

Figure 8:
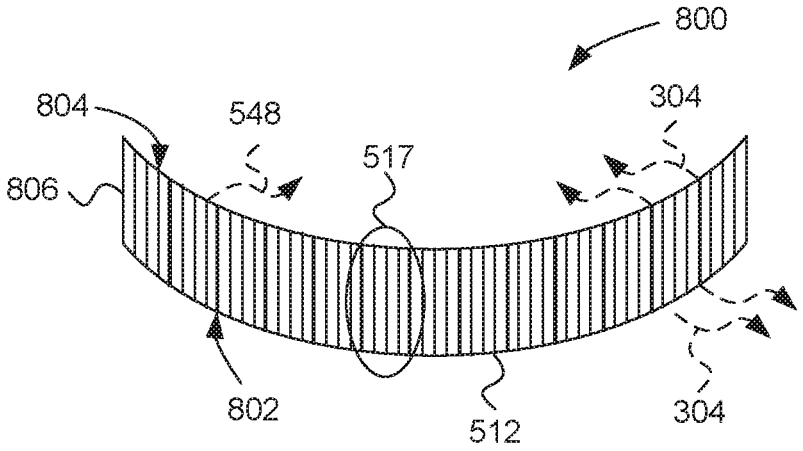
FIG. 8 is a simplified side sectional view of a non-planar perforated flame holder, according to an embodiment.

FIG. 8 is a diagrammatic side sectional view of a perforated flame holder 800 that is non-planar shaped, which includes an downwardly arched input face 802 with respect to the fuel nozzle, according to one embodiment. The flame holder 800 includes an input face 802, an output face 804, and a perimeter wall 806. The input face 802 is the input surface, and the output face 804 is the output surface of the perforated flame holder 800. The input face 802 is convexly arcuate and plane symmetric, and the output face 804 is concavely arcuate and plane symmetric, according to one embodiment. The output face 804 is hotter than the input face 802, during operation. The output face 804 is arched to inwardly project thermal radiation 304 to recycle or reuse the emitted thermal radiation 304 to maintain or sustain an operating temperature of the perforated flame holder 800, according to one embodiment. Because the output face 804 reacts at a hotter temperature than the input face 802, an inwardly arched output surface may be able to more effectively sustain the temperature of the perforated flame holder 800 than an inwardly arched input surface.

According to another aspect, the downwardly arched input surface may operate to reduce radiation directed toward a fuel nozzle (not shown) and instead direct radiation sideways, away from a fuel and oxidant stream. In experiments, the inventors found the downwardly arched shape of the embodiment 800 to be associated with a reduced tendency toward "huffing," described above in conjunction with FIGS. 2-4.

Figure 9:
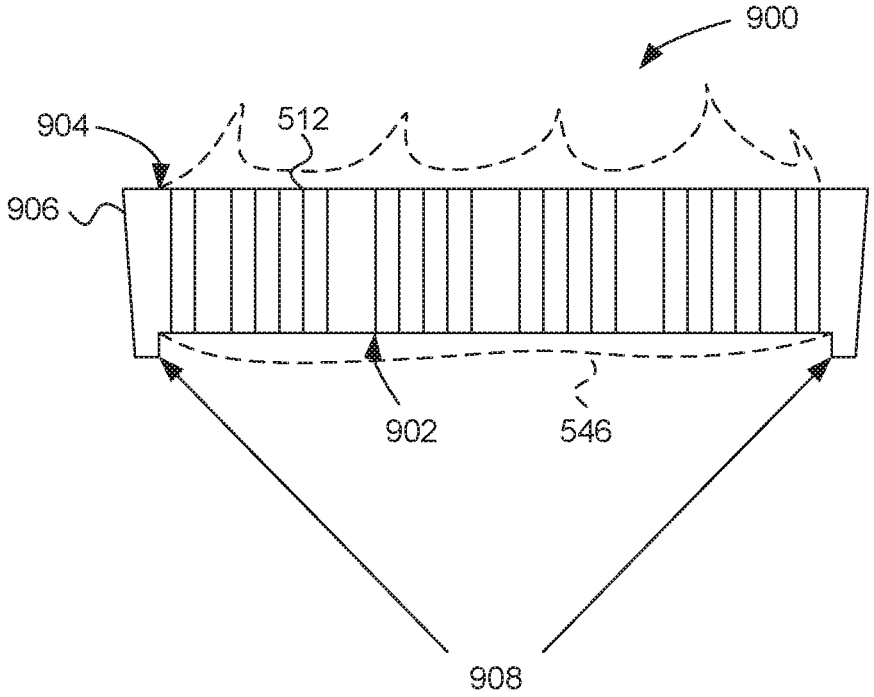
FIG. 9 is a simplified side sectional view of a non-planar perforated flame holder, according to an embodiment.

FIG. 9 is a diagrammatic side sectional view of a perforated flame holder 900 that is non-planar shaped, and which includes a curb or bump around the perimeter of the input face or the output face to reduce fuel losses, according to one embodiment. The flame holder 900 includes an input face 902, an output face 904, and a perimeter wall 906. The perimeter wall 906 is thickened to extend beyond the length of the perforations 512. The perforated flame holder 900 includes a curb 908 on the input face 902 to improve mechanical robustness of the perimeter wall 906, according to one embodiment. The curb 908 can be a lip, bump, raised surface, a thickened edge, or other extension of part of the input face 902 that reinforces the structure of the perforated flame holder 906, according to embodiments.

Figure 10:
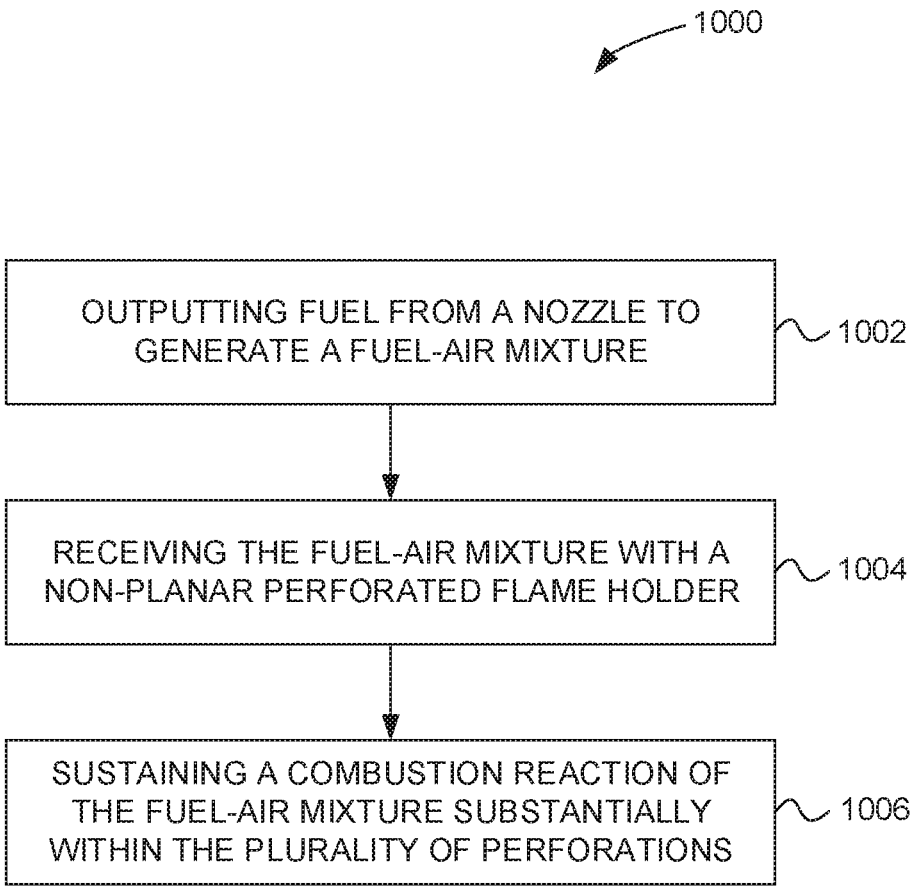
FIG. 10 is a flow diagram of a method of operating a combustion system, according to an embodiment.

FIG. 10 is a flow diagram of a method 1000 of operating a combustion system with a non-planar perforated flame holder, according to one embodiment.

At block 1002, the method includes outputting fuel from a nozzle to generate a fuel-air mixture, according to one embodiment.

At block 1004, the method includes receiving the fuel-air mixture with a non-planar perforated flame holder, according to one embodiment. The non-planar perforated flame holder includes a plurality of perforations that extend from an input face to an output face of the non-planar perforated flame holder.

At block 1006, the method includes sustaining a combustion reaction of the fuel-air mixture, substantially within the plurality of perforations. Sustaining the combustion reaction can include maintaining an operating temperature of the non-planar perforated flame holder by recycling thermal radiation in between at least some of the plurality of perforations of the input face. The non-planar perforated flame holder can recycle the thermal radiation with a concavely shaped input face that provides non-zero view factors between the plurality of perforations at the input face.

Sustaining the combustion reaction can include maintaining an operating temperature of the non-planar perforated flame holder by recycling thermal radiation in between at least some of the plurality of perforations at the output face. The non-planar perforated flame holder can recycle the thermal radiation with a concavely shaped output face that provides non-zero view factors between the plurality of perforations at the output face.

Sustaining the combustion reaction may include heating one or more fluid systems positioned proximate to the non-planar perforated flame holder by directing thermal radiation from at least some of the plurality of perforations on the output face to the one or more fluid systems. The non-planar perforated flame holder can direct the thermal radiation with a convexly shaped output face that provides non-zero view factors between at least some of the plurality of perforations and the one or more fluid systems.

Sustaining the combustion reaction can include equalizing a flow rate of the fuel-air mixture at the input face of the non-planar perforated flame holder by positioning a central portion of the non-planar perforated flame holder at a greater distance away from the fuel module then a peripheral portion of the non-planar perforated flame holder with the input face having an arcuate shape. The arcuate shape includes at least one of a parabolic arch, a spherical arch, a stepped arch, and a catenary arch.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A non-planar perforated flame holder, comprising:

an input face configured to receive a fuel-air mixture;

an output face configured to emit products of a combustion reaction of the fuel-air mixture; and a non-planar flame holder body having a plurality of perforations extending from the input face to the output face and collectively configured to promote the combustion reaction of the fuel-air mixture within the perforations;

wherein when the non-planar perforated flame holder is operably positioned a distance from a fuel nozzle, a central area of the non-planar flame holder body is configured to be further displaced from the fuel nozzle than a perimeter area of the non-planar flame holder body to equalize tensile load through the non-planar flame holder body.

2. The non-planar perforated flame holder of claim 1, wherein the non-planar flame holder body is arcuate.

3. The non-planar perforated flame holder of claim 2, wherein the non-planar flame holder body is a catenary arch.

4. The non-planar perforated flame holder of claim 2, wherein the non-planar flame holder body is parabolic.

5. The non-planar perforated flame holder of claim 2, wherein the non-planar flame holder body is rotationally symmetric.

6. The non-planar perforated flame holder of claim 1, wherein the non-planar flame holder body is a stepped arch.

7. The non-planar perforated flame holder of claim 1, wherein the input face is non-planar and is configured to equalize flow of the fuel-air mixture into the plurality of perforations.

8. The non-planar perforated flame holder of claim 1, wherein the non-planar flame holder body is arcuate and includes a departure angle that is at least 15 degrees, wherein the departure angle defines an angular displacement of an end of the non-planar flame holder body from a center of the non-planar flame holder body, wherein the departure angle is measured from a plane that is perpendicular to a longitudinal axis of the center of the non-planar flame holder body.

9. The non-planar perforated flame holder of claim 8, wherein the non-planar flame holder body is arcuate and includes a departure angle that is at least 30 degrees.

10. The non-planar perforated flame holder of claim 8, wherein the non-planar flame holder body is arcuate and includes a departure angle that is at least 45 degrees.

11. The non-planar perforated flame holder of claim 1, wherein the non-planar flame holder body is a single continuous unit.

12. The non-planar perforated flame holder of claim 1, wherein the non-planar flame holder body includes a plurality of sections that are coupled together to operate as a singular unit.

13. The non-planar perforated flame holder of claim 12, wherein the plurality of sections are coupled together with adhesive.

14. The non-planar perforated flame holder of claim 12, wherein the plurality of sections are held in place with pure compression.

15. The non-planar perforated flame holder of claim 12, wherein the plurality of sections are tiles that include at least one of a ceramic material and a cementatious material.

16. The non-planar perforated flame holder of claim 12, wherein the plurality of sections are cubical, rectangular, triangular, hexagonal, otherwise polygonal, or asymmetric so that the sections naturally fit closely together.

17. The non-planar perforated flame holder of claim 1, wherein the non-planar flame holder body is formed from a ceramic material.

18. The non-planar perforated flame holder of claim 1, wherein the non-planar flame holder body is formed from a cementatious material.

19. The non-planar perforated flame holder of claim 1, wherein the input face is concavely arched to increase view factors between the plurality of perforations to enable thermal radiation exchange between the plurality of perforations.

20. The non-planar perforated flame holder of claim 19, wherein enabling thermal radiation exchange between the plurality of perforations in the input face facilitates maintenance of an operating temperature of the non-planar perforated flame holder.

21. The non-planar perforated flame holder of claim 1, wherein the output face is concavely arched to enable thermal radiation exchange between the plurality of perforations.

22. The non-planar perforated flame holder of claim 21, wherein enabling thermal radiation exchange between the plurality of perforations in the output face facilitates maintenance of an operating temperature of the non-planar perforated flame holder.

23. The non-planar perforated flame holder of claim 1, wherein the output face is convexly arched to facilitate thermal radiation of one or more fluid systems that are positioned proximate to a periphery of the non-planar flame holder body.

24. The non-planar perforated flame holder of claim 1, wherein the input face is configured to receive the fuel-air mixture from a position external to all chords defined by the input face.

25. The non-planar perforated flame holder of claim 24, wherein at least one of the perforations is configured to receive the fuel-air mixture with a trajectory substantially parallel to at least one sidewall of the at least one of the perforations.

26. A combustion system, comprising:

a fuel and oxidant source configured to output a fuel and oxidant mixture; and a non-planar perforated flame holder positioned downstream from the fuel and oxidant source to receive the fuel and oxidant mixture and configured to hold a combustion reaction supported by the fuel and oxidant mixture, the non-planar perforated flame holder, including:

a non-planar input face configured to receive the fuel and oxidant mixture;

an output face configured to output products of a combustion reaction of the fuel and oxidant mixture; and a perforated flame holder body defining a plurality of perforations extending from the input face to the output face, the perforations being collectively configured to hold the combustion reaction;

wherein when the non-planar perforated flame holder is operably positioned a distance from the fuel and oxidant source, a central area of the perforated flame holder body is configured to be further displaced from the fuel and oxidant source than a perimeter area of the perforated flame holder body to reduce variation of a flow rate of the fuel and oxidant mixture across the input face.

27. The combustion system of claim 26, wherein the combustion system is a portion of a boiler system.

28. The combustion system of claim 26, wherein the non-planar input face is configured to equalize flow of the fuel and oxidant mixture into the plurality of perforations.

29. The combustion system of claim 26, wherein the perforated flame holder body is arcuate.

30. The combustion system of claim 29, wherein the perforated flame holder body is a catenary arch.

31. The combustion system of claim 29, wherein the perforated flame holder body is parabolic.

32. The combustion system of claim 29, wherein the perforated flame holder body is rotationally symmetric.

33. The combustion system of claim 29, wherein the perforated flame holder body is a stepped arch.

34. The combustion system of claim 26, wherein the perforated flame holder body is non-planar to equalize tensile load.

35. The combustion system of claim 26, wherein the perforated flame holder body is arcuate and includes a departure angle that is at least 15 degrees, wherein the departure angle defines an angular displacement of an end of the perforated flame holder body from a center of the perforated flame holder body, wherein the departure angle is measured from a plane that is perpendicular to a longitudinal axis of the center of the perforated flame holder body.

36. The combustion system of claim 35, wherein the perforated flame holder body is arcuate and includes a departure angle that is at least 30 degrees.

37. The combustion system of claim 35, wherein the perforated flame holder body is arcuate and includes a departure angle that is at least 45 degrees.

38. The combustion system of claim 26, wherein the perforated flame holder body includes a plurality of sections that are coupled together to operate as a singular unit.

39. The combustion system of claim 38, wherein the plurality of sections are coupled together with adhesive.

40. The combustion system of claim 38, wherein the plurality of sections are held in place with pure compression.

41. The combustion system of claim 38, wherein the plurality of sections are tiles that include at least one of a ceramic material and a cementatious material.

42. The combustion system of claim 38, wherein the plurality of sections are cubical, rectangular, triangular, hexagonal, otherwise polygonal, or asymmetric so that the sections naturally fit closely together.

43. The combustion system of claim 26, wherein the perforated flame holder body is formed from a ceramic material or cementatious material.

44. The combustion system of claim 26, wherein the input face is concavely arched to increase view factors between the plurality of perforations to enable thermal radiation exchange between the plurality of perforations.

45. The combustion system of claim 44, wherein enabling thermal radiation exchange between the plurality of perforations in the input face facilitates maintenance of an operating temperature of the non-planar perforated flame holder.

46. The combustion system of claim 26, wherein the output face is concavely arched to enable thermal radiation exchange between the plurality of perforations.

47. The combustion system of claim 46, wherein enabling thermal radiation exchange between the plurality of perforations in the output face facilitates maintenance of an operating temperature of the non-planar perforated flame holder.

48. The combustion system of claim 26, wherein the output face is convexly arched to facilitate thermal radiation of one or more fluid systems that are positioned proximate to a periphery of the perforated flame holder body.

49. The combustion system of claim 26, wherein the fuel and oxidant source includes a fuel nozzle configured to output a fuel stream toward the perforated flame holder and to mix with the oxidant to form the fuel and oxidant mixture.

50. The combustion system of claim 49, wherein one or more of the perforations extend in a direction parallel to the fuel stream.

51. A method of operating a combustion system, comprising:

outputting fuel from a nozzle to generate a fuel-air mixture;

receiving the fuel-air mixture with a non-planar perforated flame holder, wherein the non-planar perforated flame holder includes a plurality of perforations that extend from an input face to an output face of the non-planar perforated flame holder; and sustaining a combustion reaction of the fuel-air mixture substantially within the plurality of perforations;

wherein sustaining the combustion reaction further includes:

maintaining an operating temperature of the non-planar perforated flame holder by recycling thermal radiation in between at least some of the plurality of perforations of the input face, wherein the non-planar perforated flame holder recycles the thermal radiation with a concavely shaped input face that provides non-zero view factors between the plurality of perforations at the input face.

52. A method of operating a combustion system, comprising:

outputting fuel from a nozzle to generate a fuel-air mixture;

receiving the fuel-air mixture with a non-planar perforated flame holder, wherein the non-planar perforated flame holder includes a plurality of perforations that extend from an input face to an output face of the non-planar perforated flame holder; and sustaining a combustion reaction of the fuel-air mixture substantially within the plurality of perforations;

wherein sustaining the combustion reaction includes:

maintaining an operating temperature of the non-planar perforated flame holder by recycling thermal radiation in between at least some of the plurality of perforations at the output face, wherein the non-planar perforated flame holder recycles the thermal radiation with a concavely shaped output face that provides non-zero view factors between the plurality of perforations at the output face.

53. A method of operating a combustion system, comprising:

outputting fuel from a nozzle to generate a fuel-air mixture;

receiving the fuel-air mixture with a non-planar perforated flame holder, wherein the non-planar perforated flame holder includes a plurality of perforations that extend from an input face to an output face of the non-planar perforated flame holder; and sustaining a combustion reaction of the fuel-air mixture substantially within the plurality of perforations;

heating one or more fluid systems positioned proximate to the non-planar perforated flame holder by directing thermal radiation from least some of the plurality of perforations on the output face to the one or more fluid systems, wherein the non-planar perforated flame holder directs the thermal radiation with a convexly shaped output face that provides non-zero view factors between at least some of the plurality of perforations and the one or more fluid systems.

54. A method of operating a combustion system, comprising:

outputting fuel from a nozzle to generate a fuel-air mixture;

receiving the fuel-air mixture with a non-planar perforated flame holder, wherein the non-planar perforated flame holder includes a plurality of perforations that extend from an input face to an output face of the non-planar perforated flame holder; and sustaining a combustion reaction of the fuel-air mixture substantially within the plurality of perforations;

equalizing a flow rate of the fuel-air mixture at the input face of the non-planar perforated flame holder by positioning a central portion of the non-planar perforated flame holder at a greater distance away from the nozzle than a peripheral portion of the non-planar perforated flame holder with the input face having an arcuate shape.

55. The method of claim 54, wherein the arcuate shape includes at least one of a parabolic arch, a spherical arch, a stepped arch, and a catenary arch.

56. The method of claim 55, further comprising receiving the fuel-air mixture into at least one of the perforations with a trajectory substantially parallel to a sidewall of the at least one of the perforations.

* * * * *